US008231153B2

(12) United States Patent
Peter

(10) Patent No.: US 8,231,153 B2
(45) Date of Patent: Jul. 31, 2012

(54) LOCKING AND LOCK RELEASE DEVICE FOR FLAP AND LID

(75) Inventor: Winfried Peter, Witten (DE)

(73) Assignee: Happich Farhzeug-und Industrieteile GmbH (DE)

( * ) Notice: Subject to any disclaimer, the term of this patent is extended or adjusted under 35 U.S.C. 154(b) by 478 days.

(21) Appl. No.: 12/581,426

(22) Filed: Oct. 19, 2009

(65) Prior Publication Data

US 2010/0083715 A1 Apr. 8, 2010

Related U.S. Application Data

(63) Continuation-in-part of application No. 11/363,628, filed on Feb. 28, 2006, now abandoned.

(51) Int. Cl.
*E05B 3/00* (2006.01)

(52) U.S. Cl. ..... 292/336.3; 292/199

(58) Field of Classification Search ..... 292/336.3, 292/39, 112, 199
See application file for complete search history.

(56) References Cited

U.S. PATENT DOCUMENTS

| | | | | |
|---|---|---|---|---|
| 4,193,618 | A | 3/1980 | Lee et al. | 292/7 |
| 4,792,166 | A | 12/1988 | Shiraishi et al. | 292/36 |
| 5,495,731 | A | 3/1996 | Riznik | 70/108 |
| 7,003,990 | B2 | 2/2006 | Lliuk | 70/107 |

FOREIGN PATENT DOCUMENTS

| | | |
|---|---|---|
| DE | 37 12376 | 8/1988 |
| DE | 101 52 646 | 4/2003 |
| DE | 103 31 622 | 2/2005 |
| EP | 0289715 | 2/1988 |
| EP | 0798437 | 1/1997 |
| EP | 1 302 613 | 8/2002 |

*Primary Examiner* — Carlos Lugo
*Assistant Examiner* — Mark Williams
(74) *Attorney, Agent, or Firm* — Ostrolenk Faber LLP

(57) ABSTRACT

A locking device for flaps, luggage compartment flaps, doors or lids comprising a housing, an actuating handle for unlocking a locking device pivotably arranged on the housing, an actuating lever, the actuating handle being supported on the housing as a rocker; a release wheel arranged pivotably on the housing and connected with the actuating lever to move unlocking rods; a locking bolt which is movable into a locking or a freewheeling position via an actuating element; a first, rotatably mounted driver disk which is rotatable by the release wheel; a second, rotatably mounted driver disk coupled to the first driver disk in order to be carried along by rotation of the first disk, for operating a locking handle connected thereto; freewheel for the actuating handle when the locking device is locked or unlocked, because a reversing lever, which can be actuated by the locking bolt, is arranged pivotably on the housing and is rotatable by the release wheel which forms a freewheel on both sides. The actuating handle receives a pivot shaft that carries along two driving cams to allow free running action. A side marking light or closing panel over the pivot shaft at the axis. A lock panel over the light or closing.

10 Claims, 5 Drawing Sheets

LOCKING AND LOCK RELEASE DEVICE FOR FLAP AND LID

CROSS REFERENCE TO RELATED APPLICATION(S)

The present application is a continuation-in-part of U.S. patent application Ser. No. 11/363,628, filed Feb. 28, 2006 in the name of Winfried PETER, and entitled A LOCKING AND LOCK RELEASE DEVICE FOR FLAP AND LID the contents of which are incorporated by reference herein.

DESCRIPTION

The invention relates to a locking device particularly for flaps, doors or lids and particularly of vehicles, in particular for luggage compartment flaps of large-capacity vehicles for conveying people, with a housing on which an actuating handle for unlocking a locking device is pivotably arranged. The actuating handle is connected to an actuating lever and is designed in particular in the manner of a rocker. A release wheel is arranged pivotably on the housing. It brings about a movement of unlocking rods and is acted upon by the actuating lever. A locking bolt is movable into a locking or free-wheeling position via an actuating element. A first driver disk is rotatable by the release wheel. A second, rotatably mounted driver disk is coupled to the first driver disk in order to be carried along, in particular for an inside locking handle connected thereto. Means provide a freewheel for the actuating handle even when the locking device is locked.

PRIOR ART

Various locking devices for flaps, doors or lids of vehicles, for example for luggage compartment flaps of large-capacity vehicles for conveying people are known from the prior art. For example, DE 37 12 378 C1 discloses a handle for doors, flaps or lids of vehicles, comprising a handle plate which is fitted essentially flush into the associated vehicle surface. In a fixed, rest position, it completely covers an associated recessed grip. Owing to a rocker mounting, it can be pivoted when pressure is applied to an edge zone running at a distance from the pivot axis, out of its surface plane and into a raised operating position. In that position, when it is subjected to a pivoting load in the same direction of movement, it is locked against further pivoting out by means of stopping means. In order to permit transmission of the operating forces in both directions of movement of the door, flap or of the lid, in this case, the pivot axis runs centrally with respect to the handle plate. By pressure being applied to two mutually opposite edge zones, the handle plate can be transferred into opposite operating positions according to choice. In this case, the handle plate is locked in the rest position and in both operating positions by means of a latching device. The latching device comprises a latching disk which is fixed to the handle plate and interacts with at least one latching means secured on the recessed grip. This design permits an oppositely identical grasping of the handle plate in both directions of movement. The handling convenience is increased by the fact that, apart from being fixed in its rest position, the handle plate is also fixed in the two pivoted-out positions. Therefore, if the opening or closing advancing motion is interrupted, the handle plate must not, however, be pivoted out of its rest position when the advancing motion is continued. A rocker mounting arrangement described in this publication forms the starting point of the locking device on which the present invention is based.

In addition, EP 0 798 437 A1 discloses a further locking device for flaps or doors of vehicles. This locking device essentially comprises a housing having a front plate, a trough-shaped indentation in the front plate, and an actuating handle, which can be pivoted in the indentation about an axis directed parallel to the front plate and is intended for unlocking a locking device. A closing cylinder, which is arranged in the housing, is accessible from the front plate with a key and is intended for locking or releasing the actuating handle. A transmission element is connected rigidly to the actuating handle and passes through the rear wall of the housing and a connecting lever situated on the rear side of the housing is coupled to the transmission element. A first driver disk is rotatable by the connecting lever counter to the force of a restoring spring, for at least one tension rod connected thereto. The connecting lever is on the first driver disk, which arrangement permits a rotational movement of the driver disk even when the actuating handle is locked. A second, rotatably mounted driver disk is coupled to the first driver disk in order to be carried along and is intended for at least one inside unlocking handle connected thereto. This arrangement is intended, with a simple, cost-effective and compact construction both for use in the case of flaps, such as trunk flaps, and also in the case of doors, and that these can also be opened from the vehicle interior, to be precise even if the locking devices are in the operative position and an opening of the lock from the outside is not possible without a key. It is desirable in this arrangement in particular to improve the latter to the effect that a free-wheeling state is provided for the pivotable actuating handle in the locked position of the locking device in order to avoid damage to the latter.

Furthermore, DE 101 52 646 A1, belonging to the applicant, discloses a locking device, in particular for luggage compartment flaps of large-capacity vehicles for conveying people. The device includes a housing on which are arranged, in each case pivotably, an actuating handle, which is connected in a rotationally fixed manner to an actuating lever, a release wheel, which serves to move unlocking rods, and a locking bolt. The release wheel bears a driver journal which engages in a slot-like groove, that is open at the edge on an end region. A locking bolt is movable via an actuating element into a locking or freewheeling position, in order to permit a release movement of the release wheel only if the driver journal is in the closed region of the groove. In this connection, in one embodiment that the housing has a recessed grip in which the actuating handle is mounted in the manner of a rocker. The arrangement described in this publication has the advantage, inter alia, that, even when the locking device is locked, the actuating handle can be actuated until it comes into contact with a housing stop without, in the process, causing an unlocking. This locking device is therefore provided with a freewheeling state that opposes any damage. It is desirable in the case of this arrangement in particular for this locking device to be provided not only with a freewheel effective on one side but with a freewheel which is effective on both sides and is to have a simple construction.

Also, the present invention is an improvement on the device disclosed in DE 103 31 622 A1. The disclosure of that publication is entirely repeated herein, and improvements and modifications of that publication are described herein and are included in the claims hereof.

OBJECT OF THE INVENTION

Accordingly, starting from the known locking devices, the present invention is based on the object of improving and developing the known arrangements, with the previous advantages being retained, in such a manner that the previously mentioned disadvantages of known locking devices are avoided. The intention in particular is to provide a locking device having a structurally simple construction and with a freewheel on both sides for the pivotable actuating handle even when the locking device is locked. The desired arrangement is also to be simple to handle and, with regard to its other functional characteristics, is to fully satisfy the existing requirements.

SUMMARY OF THE INVENTION

This object is achieved according to the invention in that the means for providing a freewheel for the actuating handle even when the locking device is locked are formed by a reversing lever, which is actuable by the locking bolt, is arranged pivotably on the housing and can be rotated by the release wheel, in order to form a freewheel on both sides. In this manner, the possibility is created for the first time using simple means to design a locking device with a structurally simple construction and with a freewheel on both sides for the pivotable actuating handle even when the locking device is locked. This in particular avoids damage or overloading of the locking device due to the actuating handle being actuated when the locking device is locked. In this case, the locking device according to the invention is not only of structurally simple construction and therefore can be produced cost-effectively, but it is also simple to handle and also, with regard to its other functional characteristics, completely satisfies the existing requirements.

In the preferred embodiment, it is provided that the reversing lever serving to form a freewheel on both sides is of essentially angular design. Such a design is particularly advantageous in a structural respect and, in addition, can be accommodated in a space-saving manner in the housing of the locking device.

According to a further refinement feature, it is provided that the release wheel, for interaction with the reversing lever, circumferentially has an essentially semicircular recess. In this case, the release wheel expediently has, on the upper side of the essentially semi-circular recess, a stop which interacts with the reversing lever and serves essentially to limit the rotational movement of the release wheel.

It is recommended, according to a further refinement, that the release wheel, for interaction with the actuating lever, has a carry-along stop which, in the functional position, projects into the lifting region of said actuating lever. In the functional position, i.e. when the locking device is unlocked, this carry-along stop is therefore situated in the lifting region of the actuating lever while, in the non-functional position, i.e. when the locking device is locked, this carry-along stop is not situated in the lifting region of the actuating lever, so that, in this state, a freewheel on both sides is provided for the actuating handle.

A further feature provides that the reversing lever, on the end region of the elbow facing the release wheel, has a journal engaging in its essentially semicircular recess. The release wheel can be rotated in a simple manner by the reversing lever via this journal.

In a further refinement, it is expedient that the reversing lever, on the elbow facing the locking bolt has a guide groove designed in a manner such that it is open on the end side. In an alternative embodiment, the reversing lever, on the elbow facing the locking bolt, has a guide groove designed such that it is closed on the end side. It is expedient in the case of these two previously mentioned embodiments that the locking bolt, on its end region facing the reversing lever, has a journal engaging in the guide groove arranged on the elbow facing the locking bolt and is designed such that it is open or closed. Via this journal engaging in the guide groove, which is designed such that it is open or closed, the actuation of the locking bolt can be converted in a simple manner into a rotational movement of the reversing lever.

It is recommended, according to a further refinement feature, that the actuating element for the locking bolt is designed as a closing lever of a closing cylinder. This closing lever is accessible as seen from the actuating handle side and is covered by a lock flap.

In an embodiment that deviates therefrom, it is provided that the actuating element for the locking bolt is designed as a closing lever of a closing cylinder and/or as an electromotive drive and/or as a pneumatic drive of a central locking system. In the case of this embodiment, the locking device can therefore be coupled to the drives of a central locking system.

A further refinement feature provides that the first driver disk, which is rotatable by the release wheel, has at least one receptacle for an unlocking rod. A further refinement feature provides that the second driver disk, which is coupled to the first driver disk in order to be carried along, has at least one receptacle for an unlocking rod. These unlocking rods, which can be operatively connected, for example, to the rotary latch locks of a trunk flap locking system, can therefore be operatively connected either to the first and/or to the second driver disk.

A further refinement feature provides that the first driver disk and the second driver disk each have a toothing which extends over a circumferential region and has teeth meshing with one another. With these means, the rotational movement of the first driver disk can be converted into a rotational movement of the second driver disk in a simple manner.

It is recommended that the actuating handle acts via carry-along zones, which are arranged on its pivot shaft, on the actuating lever.

According to a final feature of the present invention, it is provided that the release wheel is designed such that it is pivotable in some regions in the free-wheeling state with respect to the first driver disk. In this manner, simple means can be used to rotate the release wheel by the reversing lever out of the lifting region of the actuating lever and to rotate it back into it again.

In the present invention, the actuating handle has a pivoting shaft which is central along the handle and the handle is thereby formed as a rocker. In this region, the handle is a hollow chamber allowing free-running travel.

The shaft noted has two free running zones for taking along two driving cams, allowing the motion in both directions.

There may be an optional side marking light over the shaft and in the handle. Or, a cover panel may be over that region.

For locking the handle, a key operated, spring-supported lock flap is formed. It may enclose the side light or the cover panel.

Other features and advantages of the present invention will become apparent from the following description of the invention which refers to the accompanying drawings.

BRIEF DESCRIPTION OF THE DRAWINGS

The invention is illustrated in a number of exemplary embodiments in the Figures of the drawings, in which.

DESCRIPTION OF EMBODIMENTS

The locking device 10 contains embodiments of the invention. The locking device 10 is provided for flaps, doors or lids of vehicles, in particular for luggage compartment flaps or lids of large-capacity vehicles for conveying people.

Figure 1:
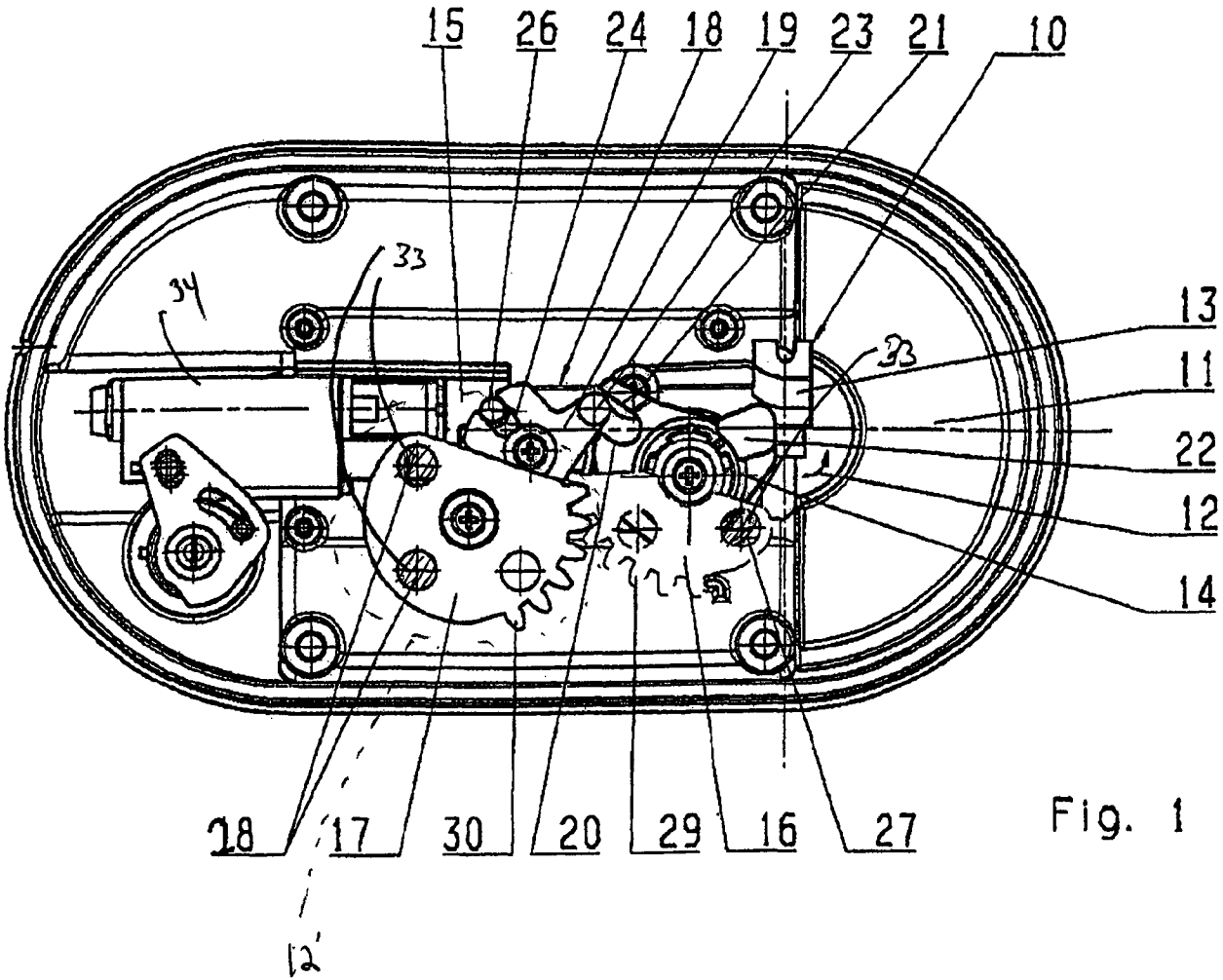
FIG. 1 shows a diagrammatic rear view of a first prior art embodiment of a locking device in the unlocked state.
Figure 2:
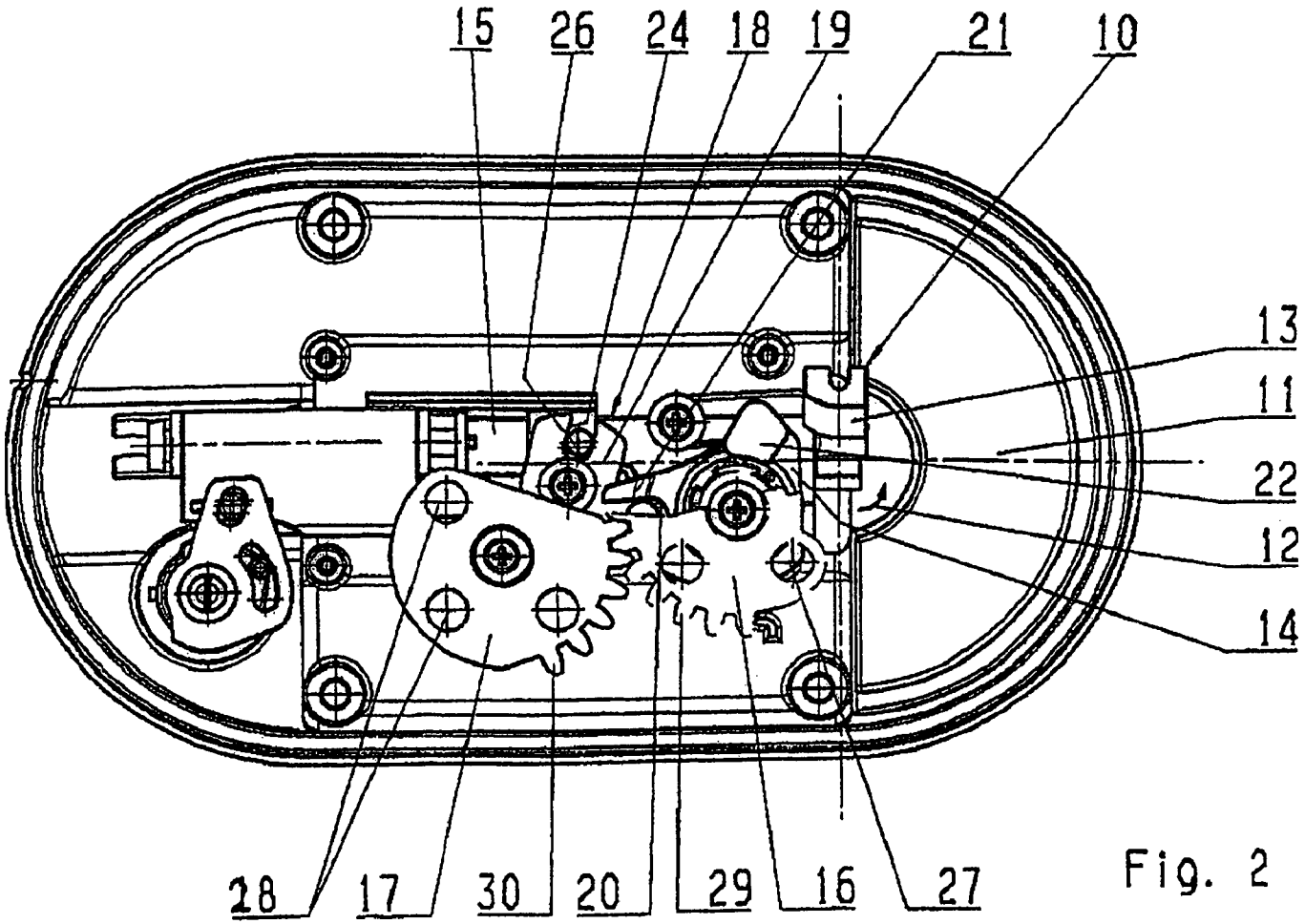
FIG. 2 shows the diagrammatic rear view of the embodiment of the locking device shown in FIG. 1, in the locked state.

The locking device 10 for example in FIG. 1 of the drawing, includes a housing 11 on which an actuating handle 12 for unlocking a locking device is pivotably arranged. The actuating handle 12 is connected to an actuating lever 13 and in this case is like a rocker. FIG. 1 of the drawing illustrates the locking device 10 in the unlocked state and FIG. 2 illustrates it in the locked state. The locking device 10 according to the invention is further provided with a release wheel 14, which is arranged pivotably on the housing 11, to bring about movement of unlocking rods 33 (shown in cross section). The release wheel 14 is acted upon by the actuating lever 13, with a locking bolt 15, which is movable into a locking or free-wheeling position via an actuating element 34. A first driver disk 16 is rotatable by the release wheel 14. A second, rotatably mounted driver disk 17 is coupled to the first driver disk 16 in order to be carried along with the disk 16 and is also provided in particular for an inside locking handle 12' (illustrated in phantom with dotted lines) connected thereto. Via this inside locking handle 12', an unlocking can be performed from the inside in a known manner when the locking device is locked.

The locking device 10 is furthermore provided with means 18 for providing a freewheel for the actuating handle 12, even when the locking device 10 is locked. In order to design a locking device with a structurally simple construction and with a freewheel on both sides for the pivotable actuating handle 12 when the locking device 10 is locked. See in this respect FIGS. 3 to 5 of the drawing. The means 18 for providing the freewheel for the actuating handle 12 even when the locking device 10 is locked comprise a reversing lever 19, which can be actuated by the locking bolt 15, is arranged pivotably on the housing 11 and is rotatable by the release wheel 14, in order to form a freewheel on both sides. In this respect, FIG. 3 the reversing lever 19, which can be actuated by the locking bolt 15 and is operatively connected to the release wheel 14, to be precise is shown here in the locked state of the locking device 10, while FIG. 4 of the drawing illustrates the unlocked state of the locking device 10. Supplementary to this, FIG. 5 of the drawing illustrates a corresponding view of the locking device 10 when the locking device is released.

Figure 3:
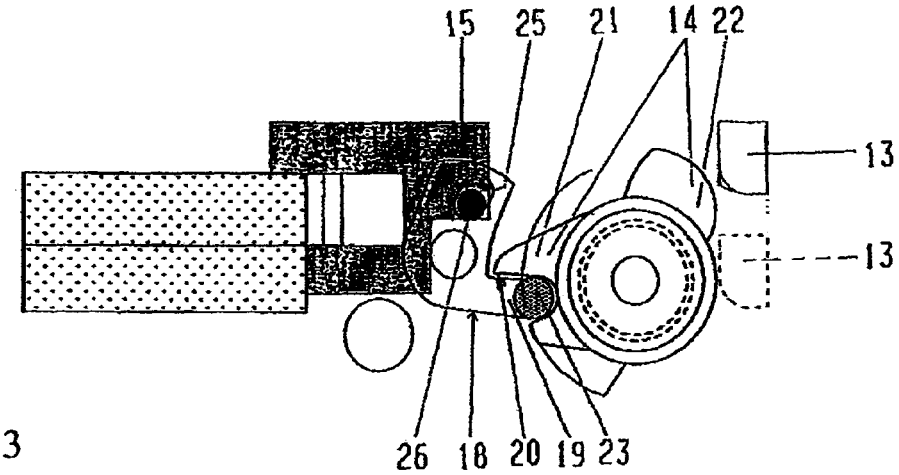
FIG. 3 shows a diagrammatic partial rear view of a modified embodiment of the locking device according to FIG. 1 in the locked state.
Figure 4:
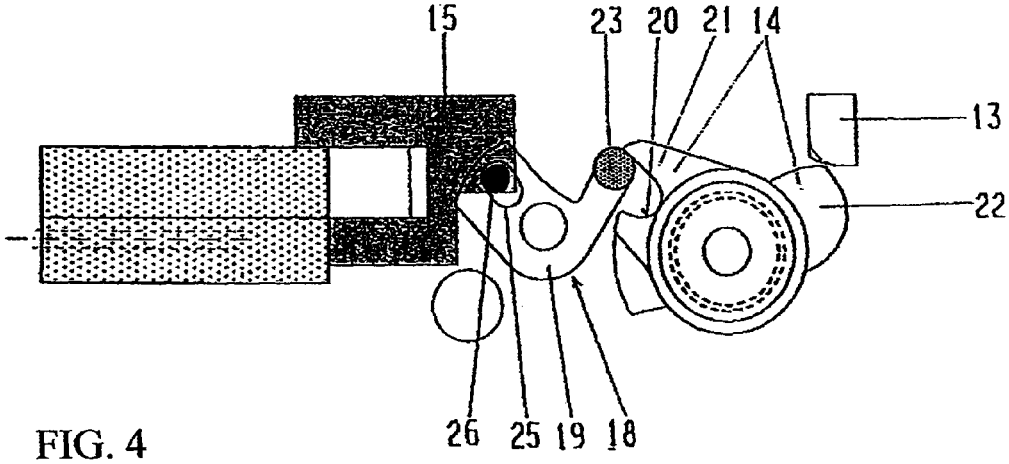
FIG. 4 shows the diagrammatic partial rear view of the modified embodiment according to FIG. 3 in the unlocked state.
Figure 5:
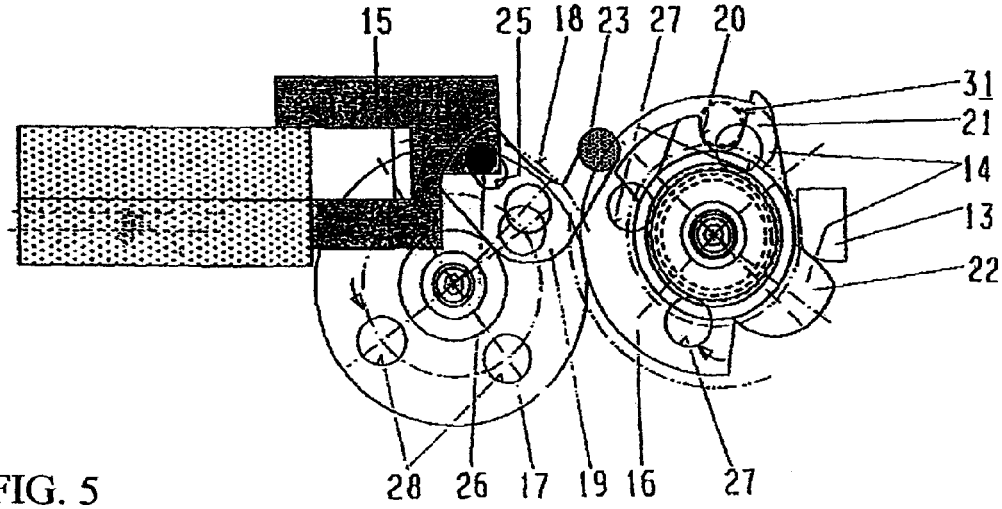
FIG. 5 shows a diagrammatic partial rear view of the modified embodiment of the locking device shown in FIG. 3, with first and second driver disks indicated, in the released state of the locking device.

The reversing lever 19 of the locking device 10 according to the invention, which reversing lever serves to form a freewheel on both sides, is of angular design or elbow in the exemplary embodiments illustrated in particular FIGS. 3 to 5 of the drawings. This is a structurally simple solution for transmitting the actuation of the locking bolt 15 to the release wheel 14, with it being possible for an angular shape reversing lever 19 to be accommodated in a space-saving manner in the housing 11 of the locking device 10.

For its interaction with the reversing lever 19, the release wheel 14 has an essentially semicircular recess at its circumference 20, as seen, for example, in FIG. 3. On the upper side of this essentially semicircular recess 20, the release wheel 14 has a stop 21 that interacts with the reversing lever 19 for limiting the rotational movement of the release wheel 14 with respect to the reversing lever 19. Furthermore, for interaction with the actuating lever 13, the release wheel 14, has a carry-along stop 22 which, in the functional position projects into the lifting region of the actuating lever. In this regard, FIG. 3 illustrates the non-functional position in the locked state of the locking device 10, and FIG. 4 illustrates the functional position in the unlocked state of the locking device 10. In this state, the carry-along stop 22 of the release wheel 14 therefore projects into the lifting region of the actuating lever 13.

The reversing lever 19, on the end region of the elbow facing the release wheel 14, has a journal 23 engaging in its essentially semicircular recess 20. In the exemplary embodiment illustrated in FIGS. 1 and 2, the reversing lever 19, on the elbow facing the locking bolt 15, has a guide groove 24 which is designed such that it is open on the end side while, in the case of the exemplary embodiment illustrated in FIGS. 3 to 5, the reversing lever 19, on the elbow facing the locking bolt 15, has a guide groove 25 which is closed on the end side. In both exemplary embodiments according to FIGS. 1 and 2 and to FIGS. 3 to 5, the locking bolt 15, on its end region facing the reversing lever 19, has a journal 26 which engages in the guide groove 24, 25 arranged on the elbow facing the locking bolt 15. The actuation of the locking bolt 15 is transmitted in a simple manner to the reversing lever 19 and therefore to the release wheel 14 via this journal 26.

In the locking device 10, the actuating element 34 for the locking bolt 15 can be a closing lever of a closing cylinder. In a modified embodiment of the locking device 10, the actuating element 34 for the locking bolt 15 can be a closing lever of a closing cylinder and/or as an electromotive drive and/or as a pneumatic drive of a central locking system.

The locking device 10 in the embodiment according to FIGS. 1 and 2 provides that the first driver disk 16, which can be rotated by the release wheel 14, has at least one receptacle 27 for an unlocking rod 33. Furthermore, the second driver disk 17, which is coupled to the first driver disk 16 so as to be carried along by it, has at least one receptacle 28 for an unlocking rod 33. These locking rods (illustrated in the drawings in cross section) can interact, for example, with the lateral rotary latch locks of a trunk flap locking system. These locking rods can be arranged either on the first driver disk 16 and/or on the second driver disk 17. In FIGS. 1 and 2, the first driver disk 16 and the second driver disk 17 in each case have a peripheral toothing 29 and 30, respectively, which extends over a circumferential region and comprises teeth which mesh with one another.

In the exemplary embodiments of the locking device 10, the actuating handle 12 furthermore acts on the actuating lever 13 via carry-along zones, which are arranged on its pivot shaft (not illustrated). These convert the pivoting or rocking movement of the actuating handle 12 into a lifting movement of the actuating lever 13.

The release wheel 14 is furthermore pivotable over some regions in the freewheeling state with respect to the first driver disk 16. Furthermore, a driver 31 arranged on the first driver disk 16 is carried along by the release wheel 14, as seen in FIG. 5.

The locking device 10 provides a freewheel on both sides for the actuating handle 12 even when the locking device 10 is locked, using structurally simple means. In the embodiment according to FIGS. 3 to 5, by actuation of the locking bolt 15, by means of the closing cylinder, or by electric motor or pneumatic drive via the central locking system, the reversing lever 19, in the locking position, moves the release wheel 14 out of the lifting region of the actuating lever 13 by means of a freewheel in the first driver disk 16. A freewheel is therefore provided on both sides of the actuating handle 12. In the other unlocked position of the locking device 10, the release wheel 14 moves in the free-wheeling state into the lifting region of the actuating lever 13. This passes the actuation on, for example, to the lateral rotary latch locks by the actuating lever 13 via the release wheel 14 and the two driver disks 16 and 17. This provides use both as a door lock and as a trunk flap lock. In the case of use as a door lock, only one unlocking rod is connected for providing guidance for a rotary latch lock of a corresponding door while in the case of use as trunk flap or lid lock, two unlocking rods are connected to be moved in an opposed manner.

As already mentioned, the embodiments illustrated are only examples of how the invention can be implemented. The invention is not restricted to them as yet more modifications and developments are possible. In particular, modifications in respect of the embodiment and arrangement of the reversing lever 19 and of the release wheel 14 are conceivable. Furthermore, a use in the case of other types of locking devices 10 than the types illustrated is provided. Other means for transmitting the rotational movement than the driver disks 16 and 17 illustrated are furthermore provided.

Figure 6:
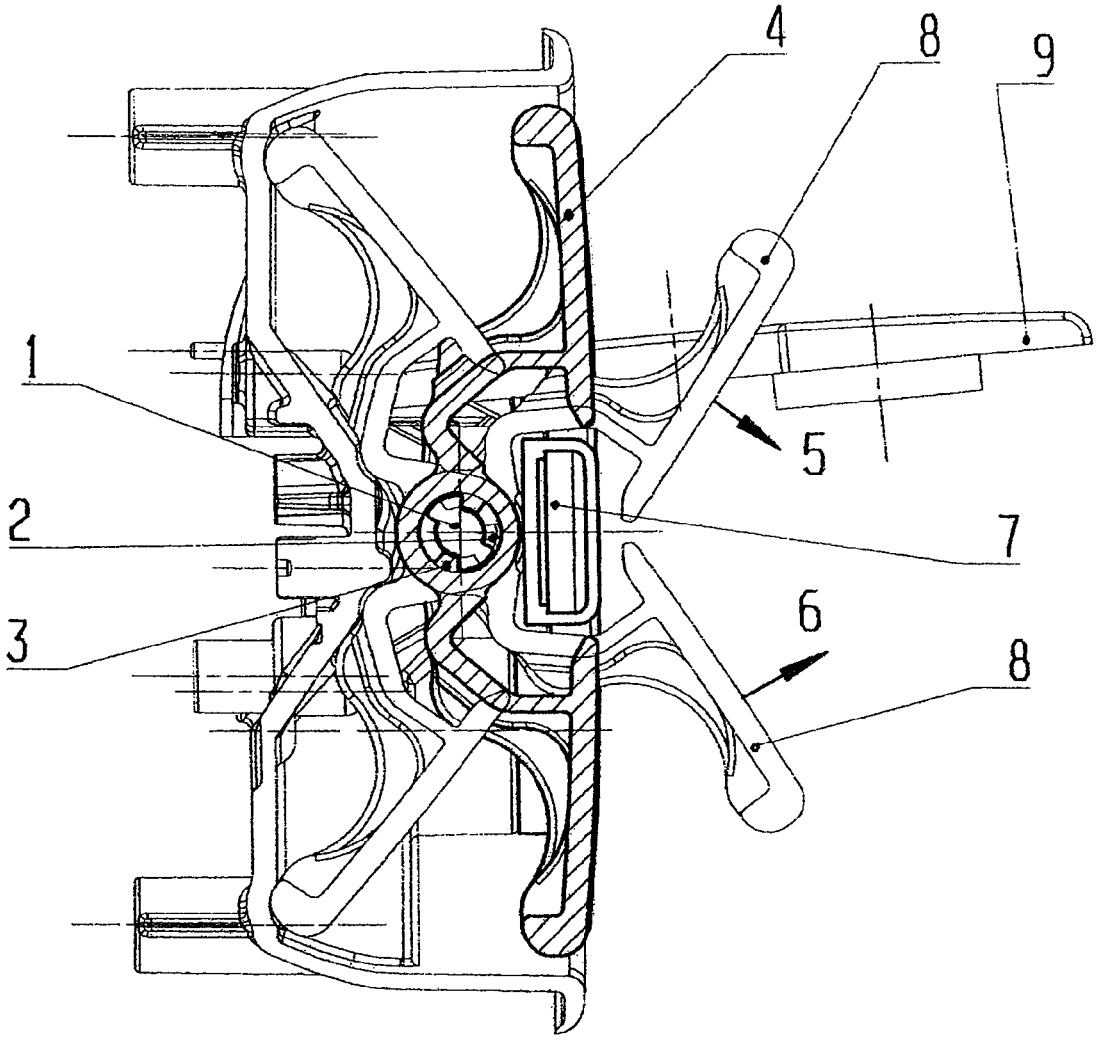
FIG. 6 shows a diagrammatic partial view of a further modified embodiment that is the subject of this invention.

In FIG. 6, it is to be additional provided that the axis of rotation 1 of the pivoting shaft for the actuating handle 4 is arranged centrally with respect to this actuating handle 4. That handle is formed in the manner of a rocker. The actuating handle 4 is formed in this region in the manner of a hollow chamber. This central arrangement of the axis of rotation 1 and the formation of the actuating handle 4 in the manner of a hollow chamber provide the advantage that the function-related, legally prescribed actuating travel and free-running travel or the corresponding opening angles can be achieved.

The centrally arranged pivoting shaft at 1 is formed with two free-running zones 2, for taking along two driving cams 3. This ensures on the one hand the neutral position of the spring-supported actuating handle 4 and on the other hand, in the operating position, the free-running action 5 in one direction and the actuating travel 6 in the other direction.

Also, optionally provided is a side marking light 7, arranged centrally over the pivoting shaft at 1 and integrated in the actuating handle 4, or alternatively a cover panel directly over this axial region.

A locking cylinder is optionally to be provided, for locking or releasing the actuating handle 4, and is preferably accessible with a key. A preferably spring-supported lock flap 9 is formed for the handle, in such a way as to enclose the contours of the side marking light.

Figure 7:
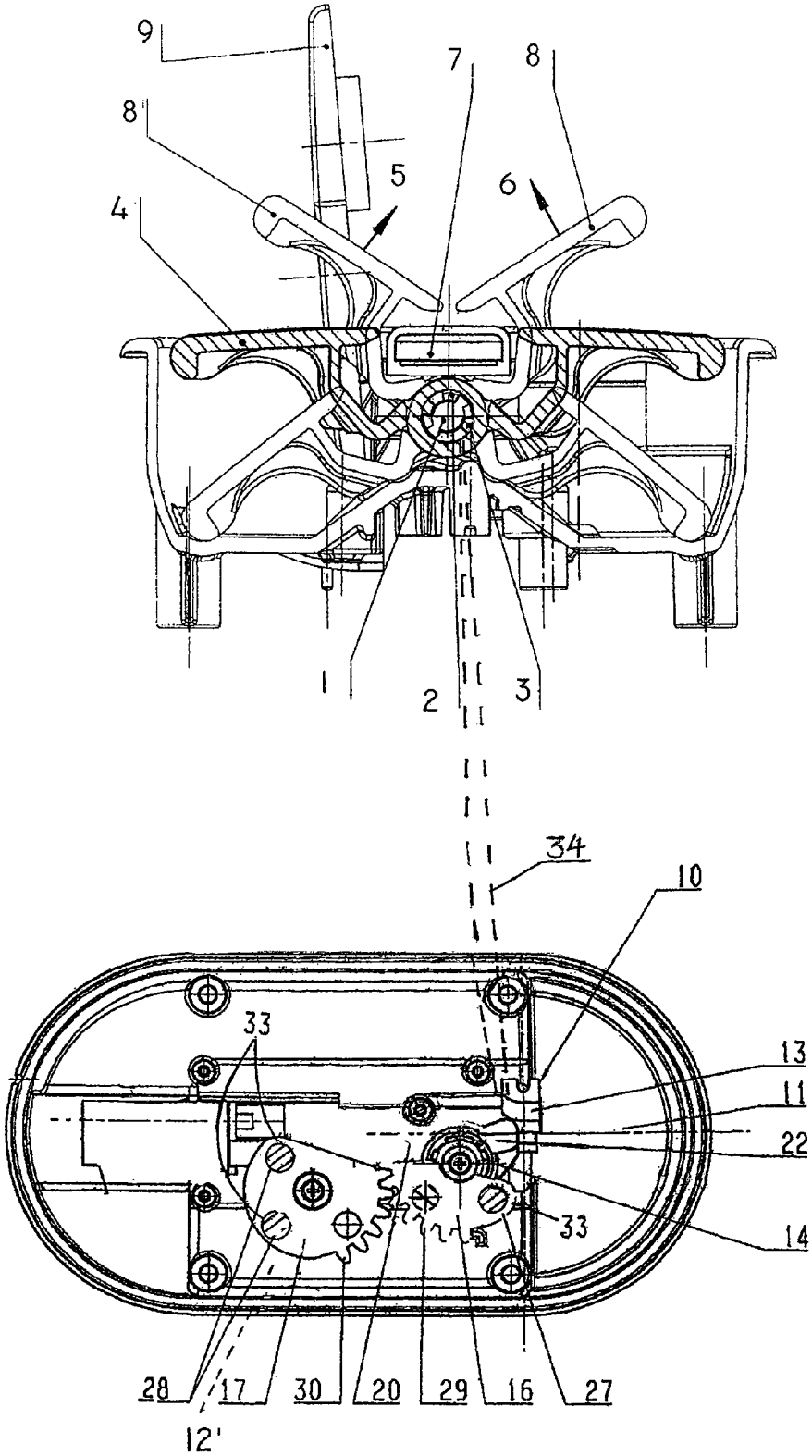
FIG. 7, schematically depicts interactive connection of the modified embodiment of FIG. 6 within the lock mechanism portion of FIG. 1.

FIG. 7 depicts the rocker handle 4 with free wheeling mechanism contained therein as described, operatively associated with the locking and drive portion of the lock mechanism 10 of FIG. 1, with freewheel means 18 and cooperative locking bolt 15 having been removed. The pivot shaft at 1 is rotatably controlled by the freewheel/driving cams 3 to move a connection 34 shown in dashed line attached to activating lever 13. Connection 34 moves activating lever 13 in a vertical direction to, in turn, activate rotational movement of release wheel 14 and, correspondingly, geared drive disks 16 and 17 bearing locking/unlocking rods 33. Locking bolt 15 may be retained, if desired, but with a direct locking engagement to activating lever 13 or release wheel 14 and without the intermediary freewheeling mechanism 18 shown in FIG. 1.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A locking device for flaps, luggage compartment flaps, doors or lids, the locking device comprising:

a housing;

an actuating pivotably arranged on the housing, the actuating handle being configured as a rocker handle having a central axis of rotation and a hollow chamber surrounding the central axis of rotation;

a central pivot shaft positioned within the hollow chamber of the rocker handle along the central axis of rotation such that the rocker handle is rotatable as a freewheel in a first direction around the central pivot shaft and is engageable with the central pivot shaft in a second direction around the central pivot shaft so as to actuate the central pivot shaft;

an actuating lever supported on the housing, the actuating lever being operatively connected to the central pivot shaft such that when the central pivot shaft is actuated by the rocker handle, the actuating lever is moved by the central pivot shaft;

a release wheel arranged pivotably on the housing and connected with the actuating lever;

a first driver disk rotatably mounted within the housing, the first driver disk being connected to the release wheel so as to be rotatable by the release wheel;

a second driver disk rotatably mounted within the housing and coupled to the first driver disk to be carried along by rotation of the first driver disk; and at least one unlocking rod positioned on one of the first driver disk and the second driver disk, the unlocking rod being movable by rotation of the one of the first driver disk and the second driver disk to selectively lock or unlock the locking device.

2. The locking device of claim 1, wherein the hollow chamber of the rocker handle includes at least two driving cams and the central pivot shaft includes at least two free running zones engageable with the driving cams.

3. The locking device as claimed in claim 1, wherein the first driver disk has at least one receptacle configured to receive the unlocking rod.

4. The locking device as claimed in claim 3, wherein the second driver disk includes at least one receptacle configured to receive the unlocking rod.

5. The locking device as claimed in claim 1, wherein the first driver disk and the second driver disk each have a respective toothing which extends over a circumferential region of each driver disk, the toothing of the first driver disk including teeth which mesh with teeth of the toothing of the second driver disk.

6. The locking device as claimed in claim 1, further comprising a side marking light positioned over the rocker handle at a position intersecting the axis of rotation.

7. The locking device of claim 6, further comprising a lockable flap over the side marking light.

8. The locking device of claim 1, further comprising a cover panel positioned over the rocker handle at the axis of rotation.

9. The locking device of claim 8, further comprising a lockable flap at the cover panel.

10. The locking device as claimed in claim 1, wherein the second driver disk includes at least one receptacle configured to receive the unlocking rod.

* * * * *